US009321623B2

(12) United States Patent
Raoven et al.

(10) Patent No.: US 9,321,623 B2
(45) Date of Patent: Apr. 26, 2016

(54) WATER DISPENSER

(71) Applicant: Zuri Naaman Victor Ltd., Rehovot (IL)

(72) Inventors: Raoven Raoven, Beitar-Illit (IL); Gidon Ben-Moshe, Jerusalem (IL)

(73) Assignee: Zuri Naaman Victor, Ltd., Rehovot (IL)

( * ) Notice: Subject to any disclaimer, the term of this patent is extended or adjusted under 35 U.S.C. 154(b) by 0 days.

(21) Appl. No.: 14/152,484

(22) Filed: Jan. 10, 2014

(65) Prior Publication Data

US 2014/0190990 A1 Jul. 10, 2014

(30) Foreign Application Priority Data

Jan. 10, 2013 (IL) ..... 224166

(51) Int. Cl.
*B67D 1/00* (2006.01)
*B67D 3/00* (2006.01)

(52) U.S. Cl.
CPC ..... *B67D 3/0003* (2013.01); *B67D 3/0009* (2013.01); *B67D 3/0022* (2013.01); *B67D 3/0045* (2013.01)

(58) Field of Classification Search
CPC .. B67D 3/0003; B67D 3/0009; B67D 3/0022; B67D 3/0045; B05C 5/001
USPC ..... 222/1, 54, 146.1, 146.2, 146.5; 239/463, 441, 445
See application file for complete search history.

(56) References Cited

U.S. PATENT DOCUMENTS

| | | | | |
|---|---|---|---|---|
| 5,678,737 | A * | 10/1997 | White | 222/484 |
| 5,865,097 | A * | 2/1999 | Smit | 99/323.3 |
| 7,672,576 | B2 | 3/2010 | Grossbach et al. | |
| 2006/0005713 | A1 * | 1/2006 | Soryas | 99/275 |
| 2009/0103907 | A1 | 4/2009 | Nave | |

* cited by examiner

*Primary Examiner* — Lien Ngo
(74) *Attorney, Agent, or Firm* — Venable LLP; Jeffri A. Kaminski

(57) ABSTRACT

A Sabbath compliant water dispenser, which comprises a hot water chamber, a heating element that is positioned in the hot water chamber for heating a body of water which is retained within the hot water chamber and a tap, through which hot water is dispensable. The water dispenser is controlled by a controller which is operable in a Sabbath mode to command the heating element to maintain the body of water at an essentially constant temperature which is near to scalding temperature and to command introduction of unheated water into the hot water chamber, when a low water level condition is detected. This way, overheating of the heating element is prevented, while also preventing the introduced water from being dispensed.

15 Claims, 3 Drawing Sheets

WATER DISPENSER

FIELD OF THE INVENTION

The present invention relates to the field of water dispensers. More particularly, the invention relates to a water dispenser for instantly supplying hot or cold water on demand that is permissible to operate during the Jewish Sabbath.

BACKGROUND OF THE INVENTION

Instant water dispensers for supplying hot or cold water on demand without delay are of great benefit to consumers. Hot water can be instantly delivered for the preparation of coffee or tea and cold water may be immediately provided on a hot day without having to stock beverages in the refrigerator.

The use of an instant water dispenser on the Sabbath has limitations. According to the Jewish religion, it is forbidden to initiate the flow of electricity or to heat water on the Sabbath to a near to scalding temperature; however, the flow of electricity may be initiated prior to the onset of the Sabbath such as by means of a timer. Thus a consumer is forbidden to cause hot water to be dispensed on the Sabbath from such a water dispenser because unheated water would be introduced to the heating chamber in response to the dispensing operation and then be heated by a heating element to the near scalding temperature.

U.S. Pat. No. 7,672,576 discloses a water dispenser with a Sabbath function. During a daily mode, a water valve controls the flow of water from an inlet to a hot water reservoir to refill the hot reservoir whenever the water level falls below a prescribed level. During a Sabbath mode, a controller turns off the valve, preventing water flow into the hot reservoir while the water remaining in the hot reservoir is constantly heated at a less than boiling temperature.

US 2009/0103907 discloses a water dispenser with similar functionality, and further describes a safety device for switching off, and preventing the overheating of, the heating elements from when the water level is low.

Since unheated water is prevented from being admitted into the hot water reservoir during the Sabbath mode, the remaining water is liable to evaporate to cause the water level to drop below a predetermined low level. After the heating elements of these as well as other prior art water dispensers are automatically deactivated when the water level in the hot water reservoir falls below the predetermined low level, the remaining water within the hot water reservoir becomes cooled and naturally cannot be reheated during the Sabbath.

It is an object of the present invention to provide a hot water dispenser that is permissible to operate during the Jewish Sabbath and that prevents the heating elements from overheating when a low water level condition is detected without being deactivated.

Other objects and advantages of the invention will become apparent as the description proceeds.

SUMMARY OF THE INVENTION

The present invention provides a Sabbath compliant water dispenser, comprising a hot water chamber, at least one heating element positioned in said hot water chamber for heating a body of water retained within said hot water chamber, a tap through which hot water is dispensable, and a controller which is operable in a Sabbath mode to command said at least one heating element to maintain said body of water at an essentially constant temperature which is at least a near to scalding temperature and to command introduction of unheated water into said hot water chamber, when a low water level condition is detected, to prevent overheating of said at least one heating element, while preventing said introduced water from being dispensed.

As referred to herein, the "Sabbath mode" is meant to include operation during both the Jewish Sabbath when the initiation of electricity flow and the heating of water to at least a near to scalding temperature are forbidden, and also during a non-Sabbath holy day when the initiation of electricity flow is forbidden but the heating of water to at least the near to scalding temperature is permissible. The "near to scalding temperature" is the threshold temperature defined by Jewish authorities to which unheated water is forbidden to be heated on the Sabbath.

The body of water is generally maintained by the at least one heating element during the Sabbath mode at an essentially constant temperature that is above 90° C. in order to prepare an enjoyable hot beverage, but the invention also includes situations for which the body of water is maintained at an essentially constant temperature that is at least the near to scalding temperature.

The at least one heating element may be configured such that a first heat element is operable during a working day mode but is disabled during the Sabbath mode and a second heating element is operable during the Sabbath mode.

Preferably, the water dispenser further comprises a control valve operatively connected to a conduit extending to the hot water chamber and through which the unheated water is introducible; and a plurality of sensors positioned in said hot water chamber, each of said sensors operative to detect a different water level in the hot water chamber. The controller is in communication with said control valve and with said plurality of sensors such that the controller is operable to command the control valve to be normally closed, to open in a working day mode when a water level in the hot water chamber falls below a predetermined high level as detected by an uppermost sensor, and to open in the Sabbath mode only when the water level in the hot water chamber falls below a predetermined low level as detected by a lowermost sensor.

In one aspect, the water dispenser further comprises conduit means for preventing impermissible dispensing of the Sabbath-introduced water.

In one embodiment, the controller is operable to command opening of the control valve during the working day mode for a first predetermined opening time when the water level in the hot water chamber falls below the predetermined high level and during the Sabbath mode, when the water level in the hot water chamber falls below the predetermined low level, for a second predetermined opening time less than said first time and of a sufficiently short duration to prevent the water level in the hot water chamber from rising above a tap level located above the predetermined low level.

In one embodiment, the plurality of sensors are conductive water level sensors by which a desired volume of water to be retained in a corresponding chamber is selectable. During the working day mode the controller is operable to command opening of the control valve when the water level in the hot water chamber falls below the predetermined high level and to command closing of the control valve when the water level in the hot water chamber rises above a predetermined intermediate level as detected by an additional sensor positioned between the uppermost sensor and the lowermost sensor.

In one embodiment, the water dispenser comprises separate hot water and cold water chambers, said cold water chamber comprising at least one chilling element and a selective water discharging element from which cold water is dispensable. Hot and cold water are instantly dispensable on demand during both a working day mode and a Sabbath mode when the low water level condition is not detected.

In one aspect, the at least one chilling element operates according to a predetermined duty cycle that is independent of the amount of water remaining within the cold water chamber.

In one aspect, the at least one chilling element operates according to the predetermined duty cycle during both the working day mode and the Sabbath mode.

In one aspect, the at least one chilling element operates according to the predetermined duty cycle during the Sabbath mode and is commanded by the controller to operate in the working day mode only when a drop in an instantaneous water level within the cold water chamber is detected.

DETAILED DESCRIPTION OF PREFERRED EMBODIMENTS

The present invention is a novel Sabbath compliant, instant hot and cold water dispenser operable in both a working day mode and Sabbath mode that continues to operate during the Sabbath mode even after the water level in the hot water chamber falls below a predetermined level that is also below the level of the tap from which water is dischargeable.

Figure 1:
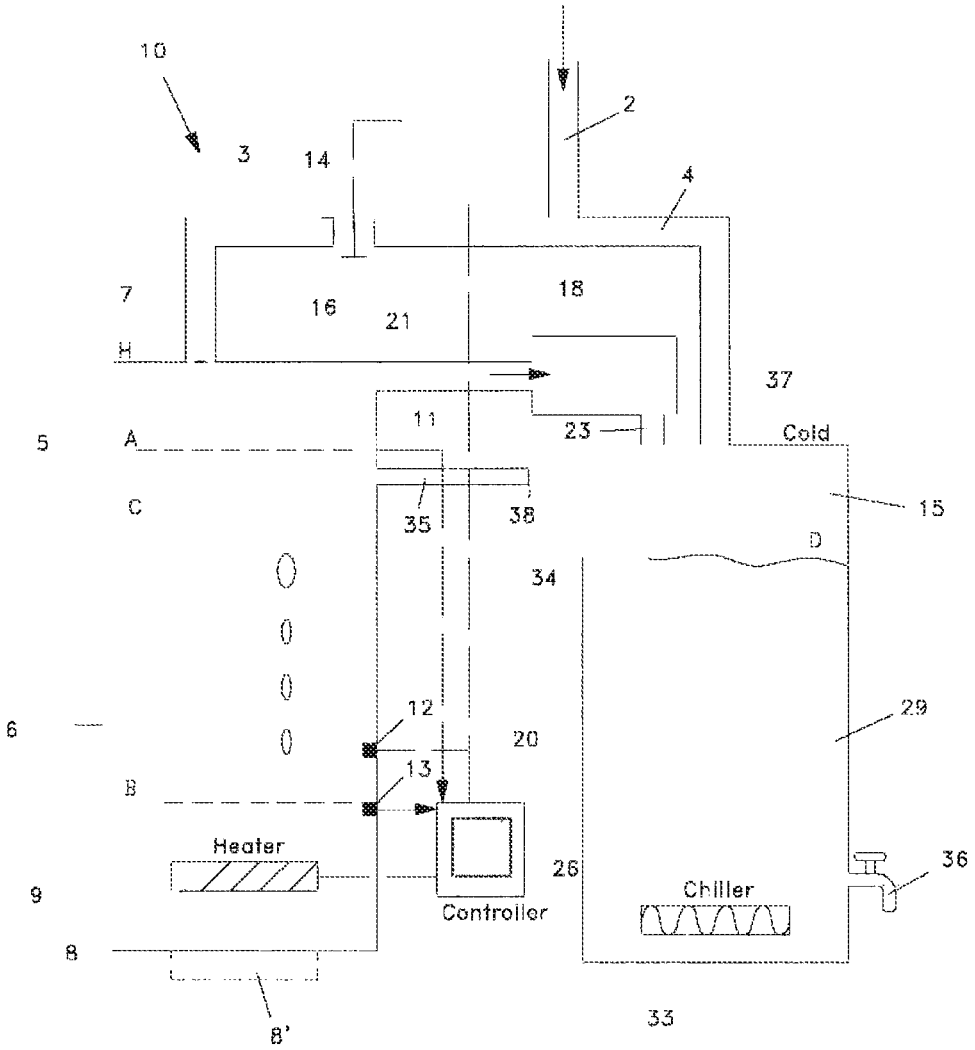
FIG. 1 is a schematic illustration of a Sabbath compliant water dispenser, according to one embodiment of the present invention.

FIG. 1 schematically illustrates the instant water dispenser of the present invention, which is generally designated by numeral 10. Water dispenser 10 is compact, having a relatively small hot water chamber 5 and cold water chamber 15 that are sufficiently large to supply a desired amount of temperature regulated water on demand during a working day mode due to the intervention of controller 20, which commands a corresponding temperature regulating element to become activated when the water level in the corresponding chamber falls below a predetermined level. Cold water chamber 15 may be considerably smaller than hot water chamber 5.

Water is admitted into water dispenser 10 via inlet conduit 2, which branches into conduit 3 extending to hot water chamber 5 and conduit 4 extending to cold water chamber 15. A control valve 14 in communication with controller 20 is operatively connected to conduit 3, in order to regulate the amount of water admitted to hot water chamber 5. A normally opened float valve 16 is mechanically connected to the wall of conduit 3 surrounding port 3 leading to hot water chamber 5, and serves as a safety feature, for example during periods of an electrical failure which causes controller 20 to malfunction, to occlude port 7 when water level C is excessively high.

Heating element 8 in communication with controller 20 is positioned near the bottom of hot water chamber 5, and is submerged within the body of water 9 remaining within chamber 5. Tap 6, or any other selective water discharging element, is positioned above heating element 8. Three vertically spaced limit switches 11-13, or any other suitable sensors, in communication with controller 20 are positioned within hot water chamber 5, or alternatively are positioned externally to hot water chamber 5, and are used to regulate the influx of water thereinto. Upper limit switch 11 is used to sense high level conditions. Intermediate limit switch 12 is located at the same level as tap 6, and lower limit switch 13 is used to sense low level conditions.

Water dispenser 10 may be equipped with a vapor collection chamber 18, in order to conserve water normally lost during evaporation. Conduit 21 extends from the top of hot water chamber 5 to vapor collection chamber 18, and conduit 23 extends from vapor collection chamber 18 to the top of cold water chamber 15. The vapor generated within hot water chamber 5 is driven to vapor collection chamber 18 by the pressure differential between hot water chamber 5 and cold water chamber 15, and then condenses when exposed to the relatively cold temperature of cold water chamber 15, flowing through conduit 23 to chamber 15.

The mode to which water dispenser 10 is set may be defined by an actuator 26 associated with controller 20.

During the working day mode, controller 20 commands control valve 14 to open when water level C within hot water chamber 5 falls below the predetermined high level A, as sensed by limit switch 11. Control valve 14 is commanded to open for a predetermined, period of time, e.g. 4 seconds, during which a corresponding amount of unheated water is admitted into chamber 5, depending on the local water pressure. Control valve 14 is commanded to become completely closed when the predetermined period of time elapses. Heating element 8 may be commanded by controller 20 to be activated in synchronization with the command to open control valve 14, at the same time or shortly thereafter. Alternatively, heating element 8 may be energized only after water discharging element 6 is selectively manipulated when a consumer wishes to receive hot water. Heating element 8 is energized during a predetermined duty cycle so that water body 9 including the introduced water will be sufficiently heated to permit hot water to be discharged from tap 6 on demand. An additional discrete amount of water will be admitted in pulse-like fashion and heating element 8 will be intermittently energized each time water level C falls below high level A.

Alternatively, controller 20 may be programmed to command control valve 14 to open and heating element 8 to be energized only when water level C within hot water chamber 5 falls below the level of tap 6, as sensed by limit switch 12, in order to conserve energy. The water may fall to this level, for example, if tap 6 is opened for a longer than expected time in order to introduce hot water into a pot If water level C falls below a predetermined low level. B as sensed by limit switch 13, a signal is transmitted to controller 20, which in turn overrides the normal opening time of control valve 14. Control valve 14 is consequently commanded by controller 20 to remain open until the water level has risen above low level B, or to remain open for an additional predetermined period of time, e.g. 2 seconds, after water level C has risen above low level B. Alternatively, control valve may be commanded to remain open for a period of time equal to a multiple of its normal opening time. The height of low level B is selected to ensure that, by taking into consideration the reaction time of control valve 14 and of the flow of water flowing through conduit 3, water level C will always remain above heating element 8 and heating element 8 will be prevented from overheating. Thus control valve 14 is used to regulate water level C to ensure that it will usually remain between high level A and low level B.

During the Sabbath mode, control valve 14 is commanded to remain normally closed even if water level C falls below high level A, to ensure that water will not be heated during the Sabbath to a near to scalding temperature. Also, heating element 8 is commanded to operate constantly, or during a duty cycle that is greater than 70%, e.g. greater than 90%, which may be characterized by a plurality of intermittent energizing and do-energizing steps, while ensuring that water body 9 remains at a constant near to, but less than, boiling temperature, when it has a sufficiently high thermal mass. The temperature to which water body 9 is heated during the Sabbath mode may be less than the temperature to which it is heated during the working day mode.

Immediately after water dispenser 10 is set to the Sabbath mode, controller 20 may be operable to command control 14 to be open for a duration longer than the normal opening time, so that water level C will rise to a maximum level.

During the course of the Sabbath, water level C drops when hot water is discharged through tap 6 for use by a consumer since the discharged water cannot be replenished, until dropping below the level of tap 6, thereby preventing the heated water from being discharged from the tap.

Water level C often drops below the level of tap 6 due to evaporation. If water level C falls below low level B, as sensed by limit switch 13, control valve 14 is commanded to be opened for a predetermined period of time, depending on the local water pressure, size of hot water chamber 5 and the height of tap 6, for ensuring that water level C will be raised above low level B but below the level of tap 6. The volume of water introduced during the Sabbath mode is sufficiently large to retain heating element 8 submerged in water and to prevent it from overheating, yet is sufficiently small to ensure that water cannot be discharged from tap 6 due to the corresponding low water level C.

Although the volume of water introduced during the Sabbath mode will be heated to a near to scalding temperature, the water dispenser is advantageously not in violation of the Sabbath. Firstly, water is not introduced into heating chamber 5 during the Sabbath as a direct result of human action. Human action caused the water level to drop only to the level of tap 6, but unpredictable evaporation caused the water level to continue to drop below low level B. Secondly, the water that is introduced and heated will not be consumed during the Sabbath since its level is assured of being below the level of tap 6.

If so desired, water dispenser 10 may be provided with a heating element 8' positioned externally to hot water chamber 5 for minimizing scale formation, yet which is able to quickly and efficiently heat the water.

In another embodiment, water dispenser 10 further comprises a conduit 35 extending between hot water chamber 5 and cold water chamber 15. A manually operated valve 38 operatively connected to conduit 35 is normally closed. During a non-Sabbath holy day when it is permissible to heat water to a near to scalding temperature and water level C within hot water chamber 5 has dropped, valve 38 is opened. Unheated water therefore flows, e.g. gravitationally flows, from cold water chamber 15 to hot water chamber 5. After a sufficient; amount of water flows into hot water chamber 5, valve 38 is reclosed, to retain the heated water within hot water chamber 5.

Figure 2:
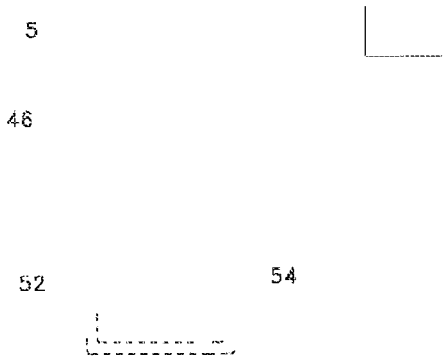
FIG. 2 is a schematic illustration of conduit means for preventing impermissible dispensing of Sabbath-introduced water.

FIG. 2 illustrates a configuration of conduit means in fluid communication with tap 46, from which hot water is dischargeable. In order to prevent any possible violation of Jewish laws resulting from consuming water heated during the Sabbath, only water located above the level of tap 46 and heated prior to the Sabbath is dispensable via the conduit means and tap 46. However, water introduced into hot water chamber 5 to a level below tap 46 and heated during the Sabbath in order to prevent the heating element from overheating will not be able to be dispensed by tilting the water dispenser and causing the water level to rise above the level of tap 46, due to the configuration of the conduit means.

An exemplary configuration of the conduit means is U-shaped, as illustrated. The inlet to the conduit means via conduit 54 is located near the center of hot water chamber 5 and above the level of water introduced during the Sabbath. The other vertical leg 52 of the conduit means extends to tap 46. Accordingly, the Sabbath introduced water is prevented from being received in the conduit means and being discharged from tap 46 even if hot water chamber 5 is tilted.

Alternatively, the conduit means extending to tap 46 may be positioned externally to hot water chamber 5 in a selected fashion that will prevent flow thereto of Sabbath-introduced water.

Referring back to FIG. 1, water dispenser 10 is set to the working day mode upon conclusion of the Sabbath, following manipulation of actuator 26. Control valve 14 is then commanded to be opened for its normal working day duration, causing water to be introduced into hot chamber 5 and to be mixed with the water introduced and heated during the Sabbath mode. Accordingly, the overheating preventing feature of water dispenser 10 allows the water introduced and heated during the Sabbath mode to be consumed following the conclusion of the Sabbath since it was not heated in violation of the Sabbath, and furthermore is mixed with other water and is not discernible. With respect to prior art means for preventing the overheating of a heating element involving deactivation of the heating element, in contrast, water remaining in the dispenser has to be replaced by a time consuming procedure after cooling.

A chilling element 33 is positioned near the bottom of cold water chamber 15, and is in communication with the body of water 29 remaining within chamber 15. Tap 36, or any other selective water discharging element, is positioned above chilling element 33. Although water level D of water body 29 temporarily drops when water is dispensed through tap 36, it immediately rises after water flows through conduit 4 and is introduced into cold water chamber 15. A normally opened float valve 34 is mechanically connected to the wall of conduit 4 surrounding port 37 leading to cold water chamber 15, and serves as a safety feature to occlude port 37 and to prevent overflowing when water level D is excessively high.

Chilling element 33 operates according to a predetermined duty cycle that is independent of the amount of water remaining within cold water chamber 15. Since chilling element 33 functions independently of any human intervention, it may be used during the Sabbath to cool water.

Figure 3:
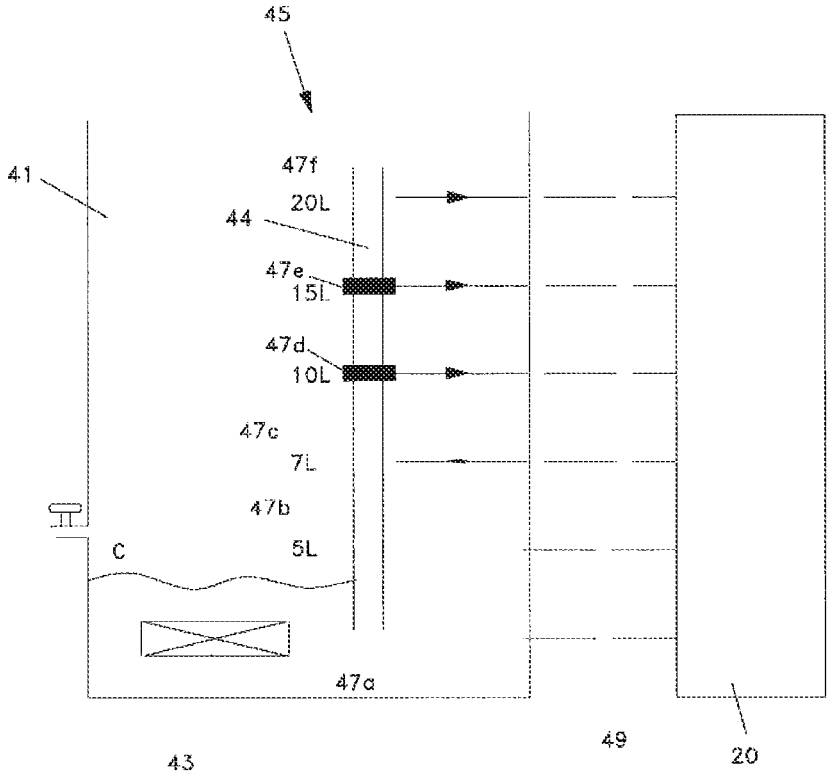
FIG. 3 is a schematic illustration of a conductive water level sensing unit for controlling the amount of water that is retainable in a water chamber.

In another embodiment of the invention illustrated in FIG. 3, each of the hot water chamber and the cold water chamber may be provided with a conductive water level sensing unit 45 for controlling the amount of water that is retainable in the water chamber.

Conductive water level sensing unit 45 comprises a holder 44 for a plurality of vertically spaced electrodes, e.g. electrodes 47*a-f*, which is mounted on a wall 41 of the corresponding water chamber. The electrodes are adapted to detect an electrical resistance when submerged in water. Controller 20 applies a low level voltage to wall 41 made of a metallic material, so that when the water level reaches one of the electrodes, the water conducts the current to the corresponding electrode to complete the circuit. An insulated conductive element 49 extends from each corresponding electrode to controller 20, which is operable to detect the water level by means of one or more electrical parameters selected from a resistance, current and voltage reading resulting from completed circuit. The current may flow through only the uppermost electrode submerged in water, or through all electrodes submerged in water.

Each of the electrodes 47*a-f* is preferably spaced by a uniform interval, e.g. an interval of 5 L, from its adjacent electrode, so that the water level can be accurately regulated. When a predetermined level is reached, a temperature regulating element 43 may be activated or deactivated, a control valve may be opened or closed, or any other control element may be suitably operated.

Figure 4:
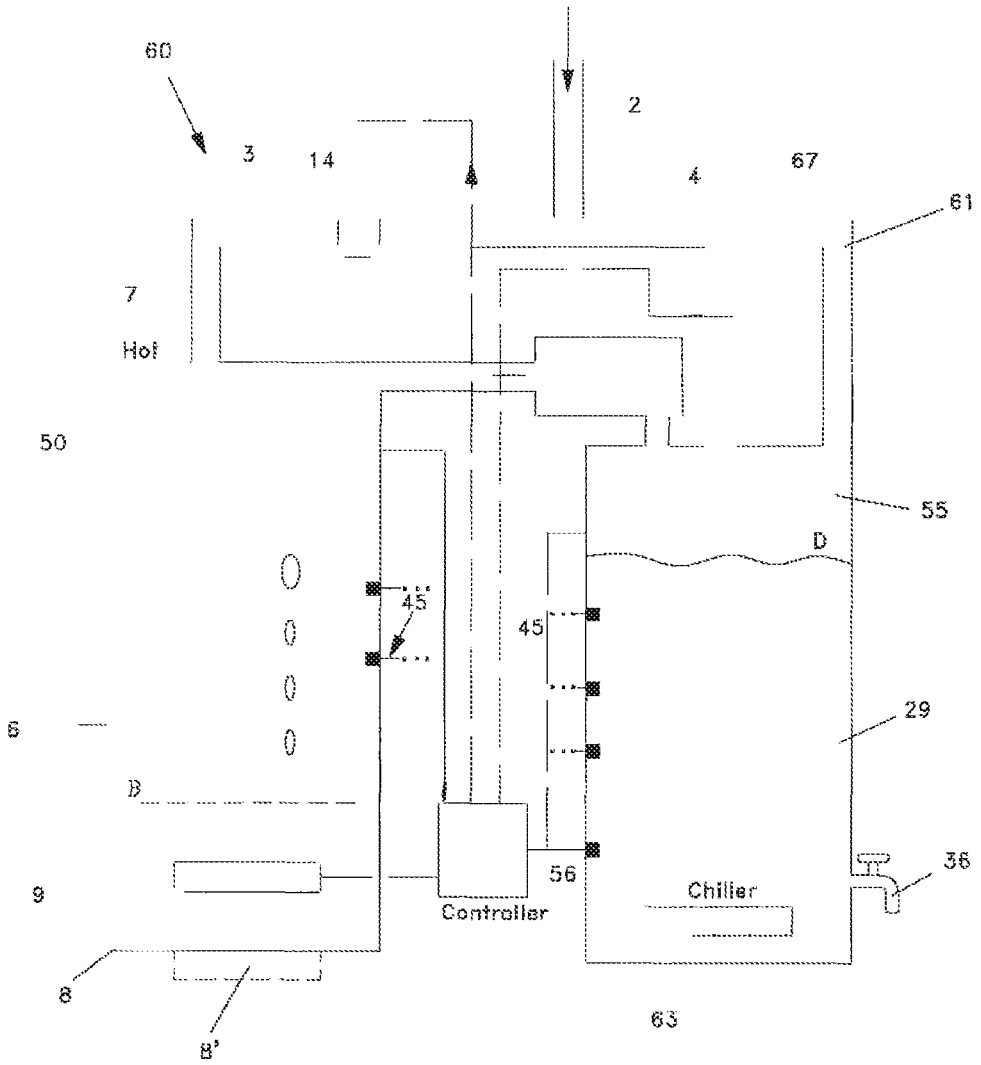
FIG. 4 is a schematic illustration of a Sabbath compliant water dispenser comprising the level sensing unit of FIG. 3.

FIG. 4 illustrates water dispenser 60 which comprises a conductive water level sensing unit 45 deployed in each of hot water chamber 50 and cold water chamber 55. Most of the components of water dispenser 60 are identical to those of water dispenser 10 illustrated in FIG. 1, and therefore need not be described, for brevity, it will be appreciated that only one of the water chambers may be provided with a conductive water level sensor.

A reduced amount of water and energy wastage may be realized by virtue of the provision of a conductive water level sensor unit 45 in hot water chamber 50 and cold water chamber 55. A selected volume of water to be retained in a chamber may be entered via panel 56, e.g. a touchscreen. Thus when the anticipated number of consumers accessing water dispenser 60 is less than a maximum number, a corresponding reduced volume of water will be introduced via the control valve when commanded by controller 20.

A control valve 62 in communication with controller 20 is operatively connected to conduit 4 extending to cold water chamber 55, in order to supply a controlled amount of unchilled water thereto. During the working day mode; control valve 62 is commanded to open when water level D drops below the selected high level corresponding to a percentage volume of cold water chamber 55, e.g. half full. Control valve 62 will remain open until water level D rises above the selected high level, or any other desired level.

Chilling element 63 in communication with controller 20 may be operated in synchronization with control valve 62 or with selective water discharging element 36. Accordingly, chilling element 63 will be operated only when there is a demand for cold water as determined by a drop in the instantaneous water level D of water body 29, thereby considerably reducing energy consumption.

During the Sabbath mode as set by means of panel 56, control valve 62 is commanded to be continuously closed and chilling element 63 is commanded to operate according to a predetermined duty cycle that is independent of the amount of water remaining within cold water chamber 55. If water level D falls below the level of the lowermost electrode, chilling element 63 may be commanded to become deactivated.

If so desired, water dispenser may be provided with a manually actuated bypass valve 67, which is opened during the Sabbath mode after control valve 62 is commanded to be continuously closed, to allow water to be introduced to cold water chamber 55. Bypass valve 67 is operatively connected to conduit 61 branching from conduit 4.

Regarding hot chamber 50, control valve 14 may be commanded to open during periods of evaporation until water level C rises above low level B.

In addition, the transfer from a daily mode to a Sabbath mode and vice versa may be done automatically by preprogramming the controller and inputting all the transition timing between Sabbath and regular days and vice versa.

Also, the amount of water in a chamber may be determined by a weight sensor that converts the water weight at the sensed level to a corresponding volume of the chamber.

According to another embodiment, a gramma switch well known to those skilled in the art may be used during the Sabbath mode, in order to activate the heating element by an indirect action while complying with Jewish religion regulations.

While some embodiments of the invention have been described by way of illustration, it will be apparent that the invention can be carried out with many modifications, variations and adaptations, and with the use of numerous equivalents or alternative solutions that are within the scope of persons skilled in the art, without exceeding the scope of the claims.

The invention claimed is:

1. A Sabbath compliant water dispenser, comprising:

a) a hot water chamber;

b) at least one heating element positioned in said hot water chamber for heating a body of water retained within said hot water chamber;

c) a tap located at a level above said at least one heating element, through which hot water is dispensable;

d) a controller which is operable in a Sabbath mode to command said at least one heating element to maintain said body of water at an essentially constant temperature which is at least a near to scalding temperature and to command introduction of unheated water into said hot water chamber to a level above a predetermined low water level, but not above the level of said tap, when the predetermined low water level condition is detected, to prevent overheating of said at least one heating element; and e) a conduit unit for preventing impermissible dispensing of said Sabbath introduced water through said tap while tilting said water dispenser.

2. The Sabbath compliant water dispenser according to claim 1, from which hot and cold water are instantly dispensable on demand during both a working day mode and a Sabbath mode when the predetermined low water level condition is not detected.

3. The Sabbath compliant water dispenser according to claim 1, further comprising:

a) a control valve operatively connected to a conduit extending to the hot water chamber and through which the unheated water is introducible; and b) a plurality of sensors positioned in said hot water chamber, each of said sensors operative to detect a different water level in the hot water chamber, wherein the controller is in communication with said control valve and with said plurality of sensors such that the controller is operable to command the control valve to be normally closed, to open in a working day mode when a water level in the hot water chamber falls below a predetermined high level as detected by an uppermost sensor, and to open in the Sabbath mode only when the water level in the hot water chamber falls below the predetermined low level as detected by a lowermost sensor.

4. The Sabbath compliant water dispenser according to claim 3, wherein the controller is operable to command opening of the control valve during the working day mode for a first predetermined opening time when the water level in the hot water chamber falls below the predetermined high level and during the Sabbath mode, when the water level in the hot water chamber falls below the predetermined low level, for a second predetermined opening time less than said first time and of a sufficiently short duration to prevent the water level in the hot water chamber from rising above the tap level located above the predetermined low level.

5. The Sabbath compliant water dispenser according to claim 3, wherein the plurality of sensors are conductive water level sensors by which a desired volume of water to be retained in a corresponding chamber is selectable.

6. The Sabbath compliant water dispenser according to claim 5, wherein during the working day mode the controller is operable to command opening of the control valve when the water level in the hot water chamber falls below the predetermined high level and to command closing of the control valve when the water level in the hot water chamber rises above a predetermined intermediate level as detected by an additional sensor positioned between the uppermost sensor and the lowermost sensor.

7. The Sabbath compliant water dispenser according to claim 2, which comprises separate hot water and cold water chambers, said cold water chamber comprising at least one chilling element and a selective water discharging element from which cold water is dispensable.

8. The Sabbath compliant water dispenser according to claim 7, wherein the at least one chilling element operates according to a predetermined duty cycle that is independent of the amount of water remaining within the cold water chamber.

9. The Sabbath compliant water dispenser according to claim 8, wherein the at least one chilling element operates according to the predetermined duty cycle during both the working day mode and the Sabbath mode.

10. The Sabbath compliant water dispenser according to claim 8, wherein the at least one chilling element operates according to the predetermined duty cycle during the Sabbath mode and is commanded by the controller to operate in the working day mode only when a drop in an instantaneous water level within the cold water chamber is detected.

11. The Sabbath compliant water dispenser according to claim 1, further comprising:

a) a control valve operatively connected to a conduit extending to the hot water chamber and through which the unheated water is introducible; and b) a plurality of sensors positioned externally to the hot water chamber, each of said sensors operative to detect a different water level in the hot water chamber, wherein the controller is in communication with said control valve and with said plurality of sensors such that the controller is operable to command the control valve to be normally closed, to open in a working day mode when a water level in the hot water chamber falls below a predetermined high level as detected by an uppermost sensor, and to open in the Sabbath mode only when the water level in the hot water chamber falls below the predetermined low level as detected by a lowermost sensor.

12. The Sabbath compliant water dispenser according to claim 7, further comprising a conduit extending between the hot water chamber and the cold water chamber, and a manually operated, normally closed valve operatively connected to said conduit for permitting, when temporarily opened, unheated water to flow on a non-Sabbath holy day from the cold water chamber to the hot water chamber and to be heated.

13. The Sabbath compliant water dispenser according to claim 7, further comprising a vapor collection chamber in fluid communication with both the hot water chamber and the cold water chamber, vapor generated within the hot water chamber being driven to said vapor collection chamber by a pressure differential between the hot water chamber and the cold water chamber and being condensable, when exposed to the relatively cold temperature of the cold water chamber, so as to be discharged into the cold water chamber.

14. The Sabbath compliant water dispenser according to claim 1, wherein the conduit unit is a U-shaped conduit having a first vertical leg positioned within a central region of the hot water chamber and provided with an inlet located above a maximum height of the Sabbath-introduced water, a second vertical leg spaced from said first leg, and a terminal element that extends from said second leg to the tap, to prevent the Sabbath-introduced water from being received within said inlet even if the water dispenser is tilted.

15. The Sabbath compliant water dispenser according to claim 1, wherein the conduit unit is positioned externally to the hot water chamber in a selected fashion that will prevent flow thereto of the Sabbath-introduced water.

* * * * *